US008146544B2

(12) United States Patent
Lopez-Crevillen et al.

(10) Patent No.: US 8,146,544 B2
(45) Date of Patent: Apr. 3, 2012

(54) ENGINE CYLINDER HEAD COOLING FEATURES AND METHOD OF FORMING

(75) Inventors: Jose Manuel Lopez-Crevillen, Farmington Hills, MI (US); Edward R. Romblom, De Witt, MI (US); Robert J. Moran, Ann Arbor, MI (US)

(73) Assignee: GM Global Technology Operations LLC

( * ) Notice: Subject to any disclaimer, the term of this patent is extended or adjusted under 35 U.S.C. 154(b) by 434 days.

(21) Appl. No.: 12/398,481

(22) Filed: Mar. 5, 2009

(65) Prior Publication Data

US 2010/0224144 A1 Sep. 9, 2010

(51) Int. Cl.
*F02F 1/36* (2006.01)

(52) U.S. Cl. ..... 123/41.82 R; 123/41.82 A; 29/888.06

(58) Field of Classification Search ..... 123/41.82 R, 123/41.82 A, 41.72, 41.79; 29/888.06
See application file for complete search history.

(56) References Cited

U.S. PATENT DOCUMENTS 6,295,963 B1 * 10/2001 Kollock et al. ..... 123/193.5
6,513,506 B1 * 2/2003 Ito et al. ..... 123/568.13
7,225,766 B2 6/2007 Zahdeh
7,234,422 B2 6/2007 Schlautman et al.
7,430,994 B2 * 10/2008 Petutsching et al. ... 123/41.82 R
7,784,442 B2 * 8/2010 Lester et al. ..... 123/193.5
2001/0039908 A1 * 11/2001 Bilek et al. ..... 114/55.5
2002/0026909 A1 * 3/2002 Akiwa et al. ..... 123/41.82 R
2005/0087154 A1 * 4/2005 Hayman et al. ..... 123/41.82 R
2007/0215074 A1 * 9/2007 Rozario et al. ..... 123/41.82 R
2009/0007858 A1 * 1/2009 Hochmayr et al. ..... 123/41.74

* cited by examiner

*Primary Examiner* — Noah Kamen
*Assistant Examiner* — Hung Q Nguyen
(74) *Attorney, Agent, or Firm* — Harness, Dickey & Pierce, P.L.C.

(57) ABSTRACT

A method of forming a cylinder head includes casting the cylinder head to include an integral cast-in exhaust manifold. The integral cast-in exhaust manifold defines an intermediate exhaust gas passage in fluid communication with exhaust ports and an exhaust gas outlet passage in fluid communication with the intermediate exhaust gas passage. The cast cylinder head includes a coolant cavity to receive a cooling fluid. The coolant cavity includes first and second portions extending around an outer circumference of the exhaust gas outlet passage separated from one another by a first cast-in wall. The method further includes machining the first cast-in wall to provide fluid communication between the first and second portions of the coolant cavity. Machining the first cast-in wall forms a first coolant passage created by the first and second portions of the coolant cavity and the machined passage around the outer circumference of the exhaust gas outlet passage.

13 Claims, 6 Drawing Sheets

ENGINE CYLINDER HEAD COOLING FEATURES AND METHOD OF FORMING

FIELD

The present disclosure relates to engine cylinder head geometry and manufacturing.

BACKGROUND

This section provides background information related to the present disclosure which is not necessarily prior art.

Engine assemblies may include a cylinder head having a cast-in integral exhaust manifold. Exhaust manifolds integrally formed with a cylinder head may include an exhaust gas outlet positioned closer to the exhaust ports of the cylinder head than traditional exhaust manifolds. The increased proximity of the exhaust gas outlet to the exhaust ports may result in higher temperatures being experienced at the exhaust gas outlet. These higher temperatures may result in increased thermal loads being applied to the exhaust manifold and even melting of regions of the exhaust manifold such as the outlet flange. During these high temperature conditions, portions of the outlet flange defining bolt holes may soften, reducing the sealed engagement between the outlet flange and another component such as a turbocharger manifold.

SUMMARY

This section provides a general summary of the disclosure, and is not comprehensive of its full scope or all of its features.

A method of forming a cylinder head may include casting the cylinder head to include an integral cast-in exhaust manifold. The integral cast-in exhaust manifold may define an intermediate exhaust gas passage in fluid communication with exhaust ports and an exhaust gas outlet passage in fluid communication with the intermediate exhaust gas passage. The cast cylinder head may include a coolant cavity to receive a cooling fluid. The coolant cavity may include first and second portions extending around an outer circumference of the exhaust gas outlet passage and separated from one another by a first cast-in wall. The method may further include machining the first cast-in wall to provide fluid communication between the first and second portions of the coolant cavity. Machining the first cast-in wall may form a first coolant passage created by the first and second portions of the coolant cavity and the machined passage around the outer circumference of the exhaust gas outlet passage.

A cast cylinder head may include an exhaust port, an exhaust manifold, and a coolant cavity. The exhaust manifold may be in fluid communication with the exhaust port. The exhaust manifold may define an exhaust gas outlet passage and an intermediate exhaust gas passage providing fluid communication between the exhaust port and the exhaust gas outlet passage. The coolant cavity may include first and second portions extending around an outer circumference of the exhaust gas outlet passage. The first and second portions may be in fluid communication with one another through a first machined passage.

The first and second portions of the coolant cavity may be in fluid communication with one another around an entire outer circumference of the exhaust outlet passage.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only and are not intended to limit the scope of the present disclosure in any way.

Corresponding reference numerals indicate corresponding parts throughout the several views of the drawings.

DETAILED DESCRIPTION

Examples of the present disclosure will now be described more fully with reference to the accompanying drawings. The following description is merely exemplary in nature and is not intended to limit the present disclosure, application, or uses.

Figure 1:
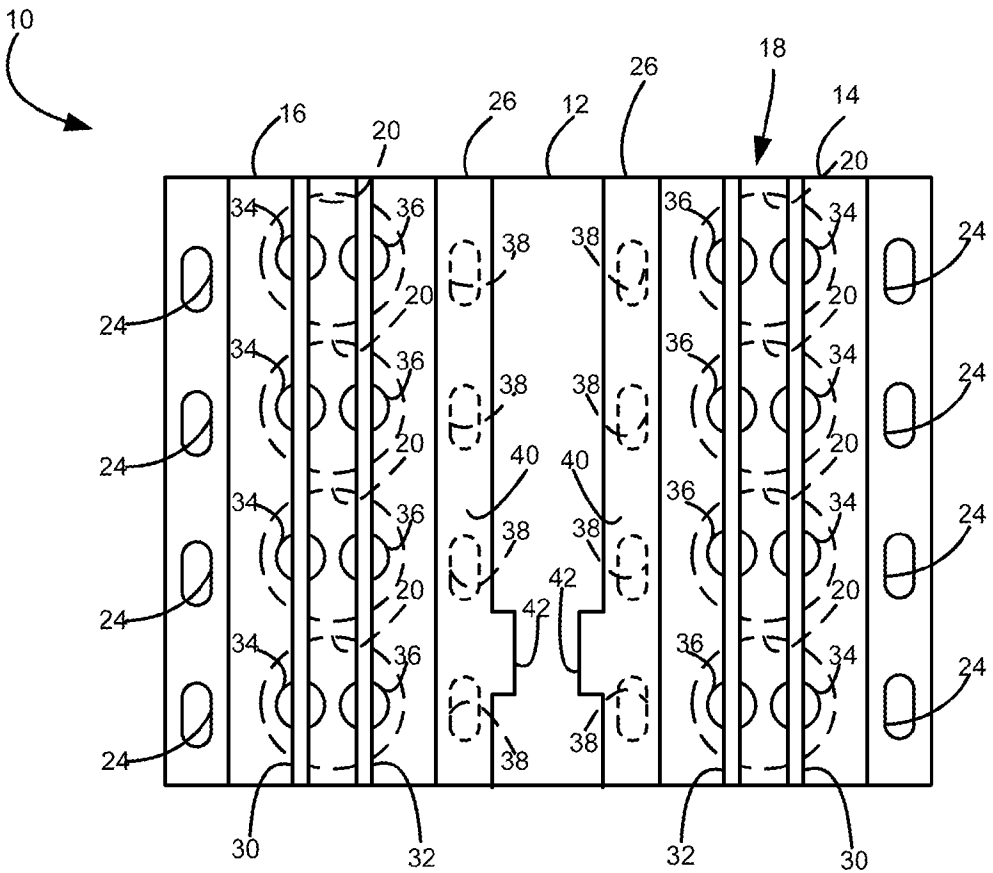
FIG. 1 is a schematic illustration of an engine assembly according to the present disclosure.

Referring to FIG. 1, an exemplary engine assembly 10 is schematically illustrated. The engine assembly 10 may include an engine block 12, a first cylinder head 14, a second cylinder head 16, and a valvetrain assembly 18. The engine block 12 may have a V-configuration, forming first and second cylinder banks that define first and second sets of cylinder bores 20 disposed at an angle relative to one another to form the V-configuration. While illustrated as a V-configuration, it is understood that the present disclosure is in no way limited to V-configuration engines. The present disclosure applies equally to a variety of other engine configurations including, but not limited to, inline engines. The first cylinder head 14 may be coupled to the first bank and the second cylinder head 16 may be coupled to the second bank.

The engine assembly 10 may form an inboard exhaust configuration where intake ports 24 are located on an outboard side of the first and second cylinder heads 14, 16 and exhaust ports 38 are located on an inboard side of the first and second cylinder heads 14, 16. While illustrated as an inboard exhaust configuration, it is understood that the present disclosure applies equally to outboard exhaust configurations.

The first and second cylinder heads 14, 16 may be generally similar to one another. Therefore, the first cylinder head 14 will be described below, with the understanding that the description applies equally to the second cylinder head 16. With additional reference to FIGS. 2 and 6, the first cylinder head 14 may define intake ports 24, an integrated exhaust manifold 26, and a coolant cavity 28. The intake ports 24 may generally provide for flow of air into the cylinder bores 20. The integrated exhaust manifold 26 may be formed with the first cylinder head 14 as an integral casting, as discussed in more detail below. The coolant cavity 28 may receive a cooling fluid from a coolant supply to maintain a desired temperature of the cylinder head 14 during engine operation.

As seen in FIG. 1, the valvetrain assembly 18 may include intake camshafts 30, exhaust camshafts 32, intake valves 34, and exhaust valves 36. The intake and exhaust camshafts 30, 32 may be rotatably supported on the first and second cylinder heads 14, 16. The intake camshafts 30 may be engaged with the intake valves 34 to selectively provide fluid communication between the cylinder bores 20 and the intake ports 24.

The exhaust camshafts 32 may be engaged with the exhaust valves 36 to selectively provide fluid communication between the cylinder bores 20 and the integrated exhaust manifold 26.

Figure 2:
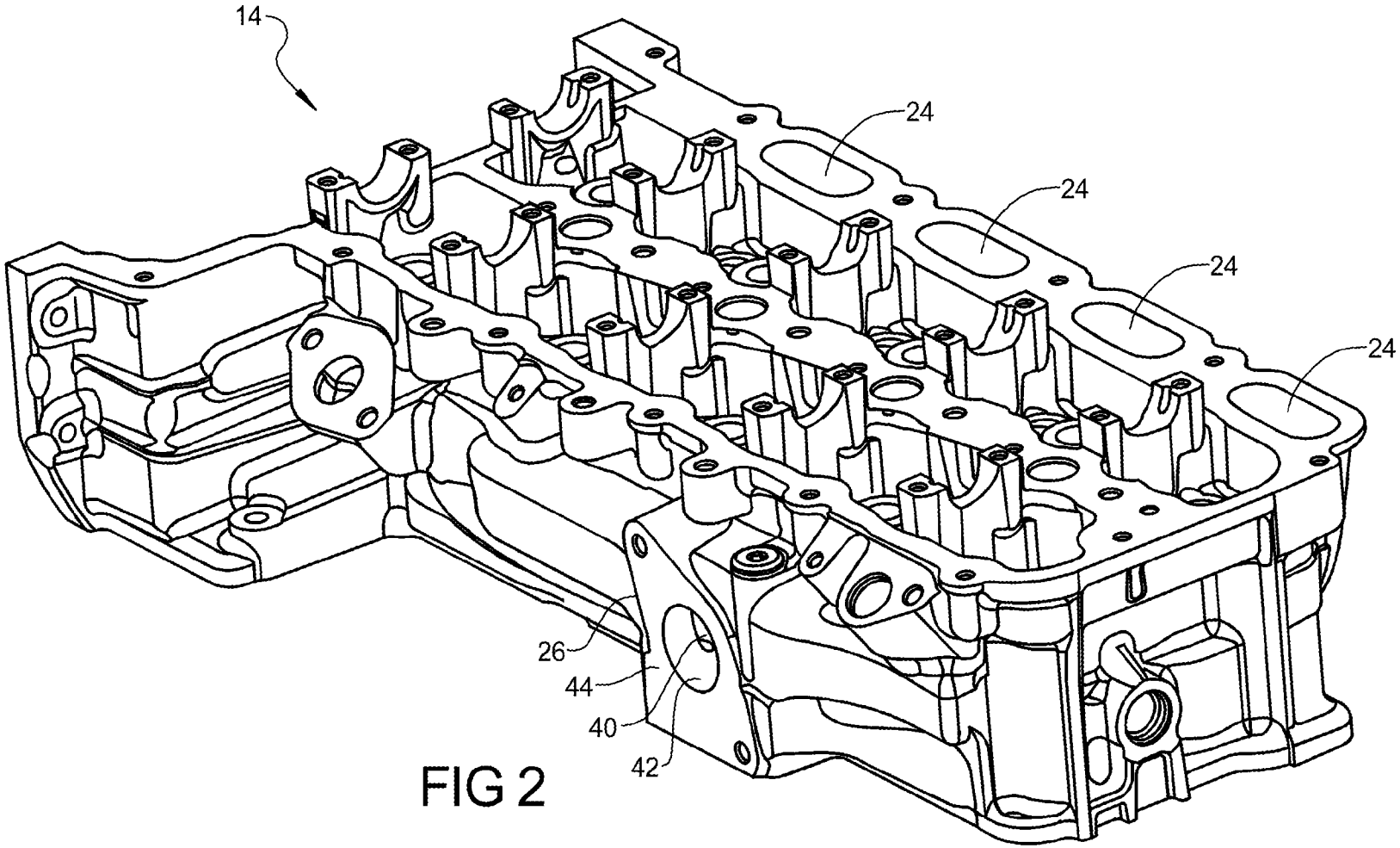
FIG. 2 is a perspective view of the cylinder head of the engine of FIG. 1.
Figure 6:
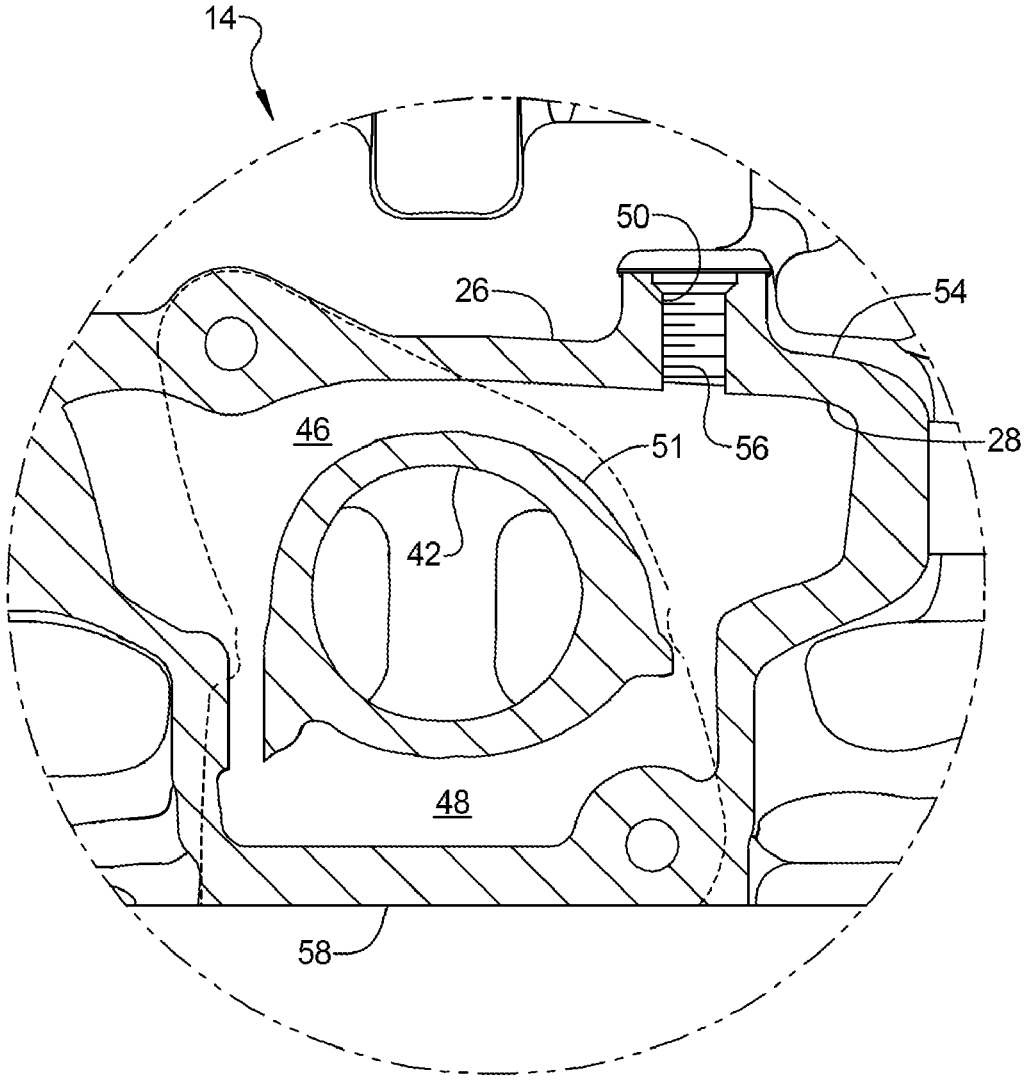
FIG. 6 is a fragmentary section view of the cylinder head of FIG. 2 in a second state.

As seen in FIGS. 2 and 6, the integrated exhaust manifold 26 may include exhaust ports 38, an intermediate exhaust gas passage 40, an exhaust gas outlet 42 and an outlet flange 44. The coolant cavity 28 may extend through the integrated exhaust manifold 26. The coolant cavity 28 may include first and second portions 46, 48. The first and second portions 46, 48 may be cast-in features. The first portion 46 may extend around a first circumferential extent of a wall 51 defining the exhaust gas outlet 42 and the second portion 48 may extend around a second circumferential extent of the wall 51 defining the exhaust gas outlet 42. As seen in FIG. 6, in a second (or finished) state, the first and second portions 46, 48 of the coolant cavity 28 may be in fluid communication with one another, extending around an entire circumference of the wall 51 defining the exhaust gas outlet 42.

A first passage 50 may extend through an outer wall 54 of the integrated exhaust manifold 26 and into the first portion 46 of the coolant cavity 28. The first passage 50 may include a threading 56 at an upper portion thereof for engagement with a temperature sensor (not shown). Alternatively, the first passage 50 may be capped and sealed (not shown). A second passage 52 (seen in FIG. 5) may extend through a lower surface 58 of the first cylinder head 14 and may form a fluid passage for communication with a coolant supply (not shown). The coolant supply may include a coolant flow from the engine block 12 and may be metered by an orificed opening in a gasket (not shown) located between the engine block 12 and the first cylinder head 14.

The extent of the coolant cavity 28 around an entire circumference of the exhaust gas outlet 42 may provide improved cooling for the outlet flange 44 of the integrated exhaust manifold 28. By way of non-limiting example, the extent of the coolant cavity 28 may maintain the outlet flange 44 below a predetermined temperature to ensure a sealed engagement with a downstream component, such as a turbocharger manifold (not shown). More specifically, the extent of the coolant cavity 28 may generally prevent the region of the outlet flange 44 defining bolt holes 45 from softening and/or deforming.

Figure 3:
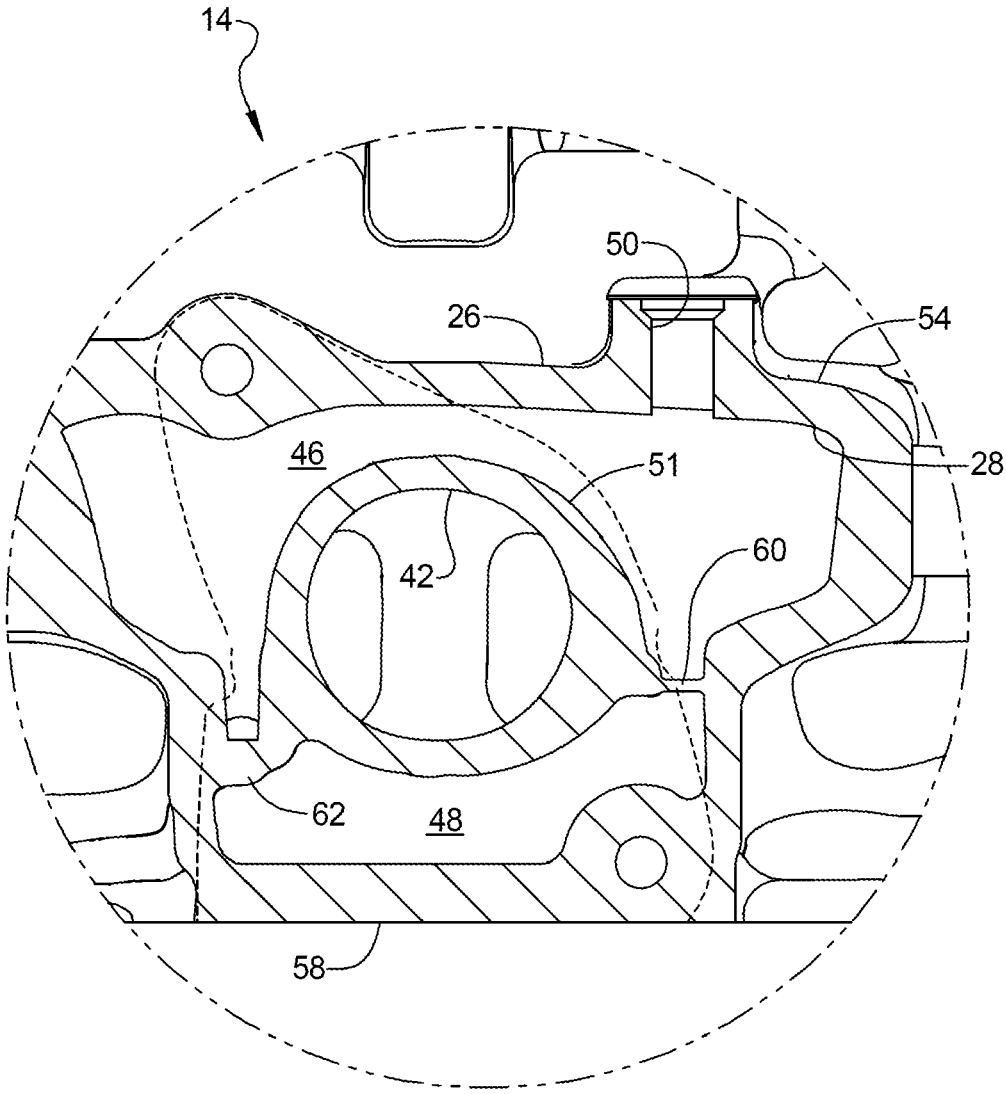
FIG. 3 is a fragmentary section view of the cylinder head of FIG. 2 in a first state.
Figure 4:
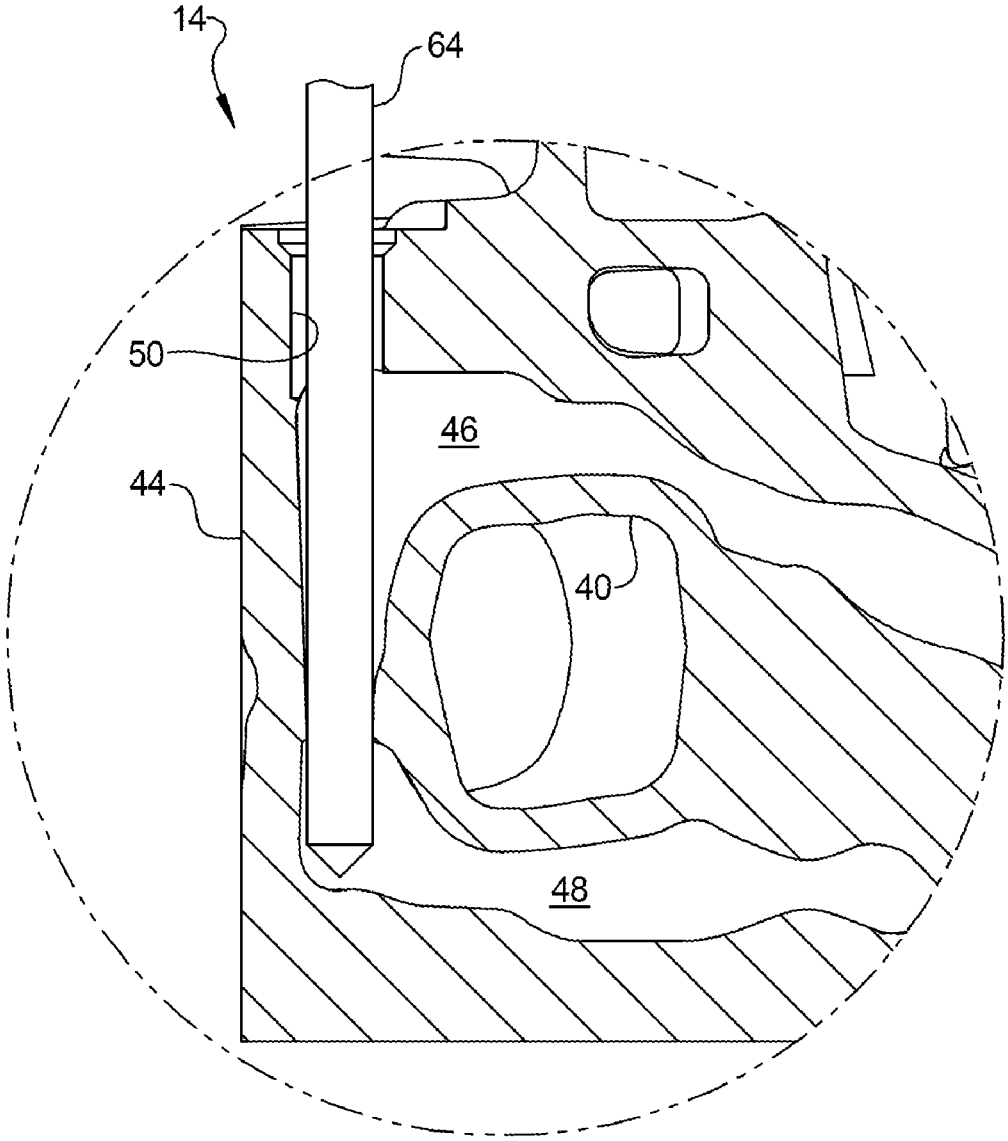
FIG. 4 is a fragmentary section view of the cylinder head of FIG. 2 and a first tool.
Figure 5:
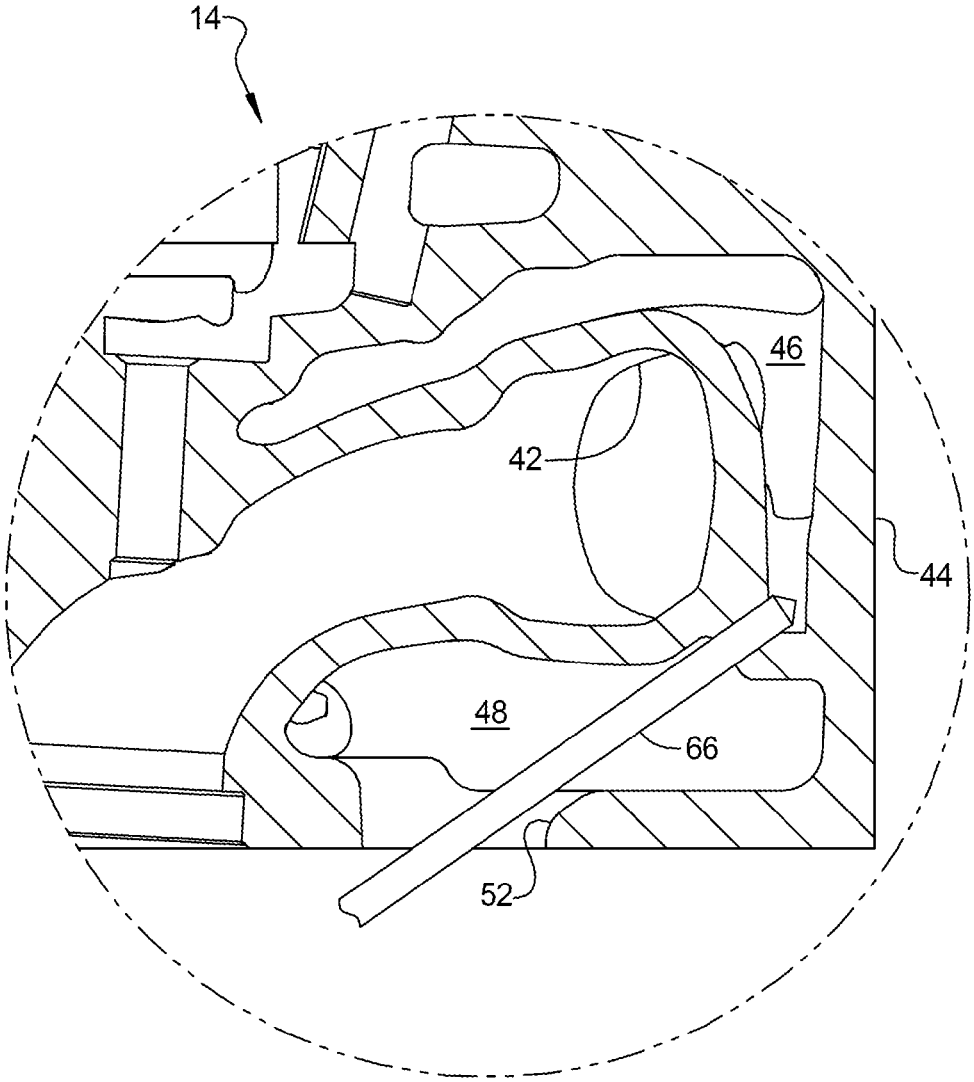
FIG. 5 is a fragmentary section view of the cylinder head of FIG. 2 and a second tool.

FIGS. 3-5 generally illustrate the first cylinder head 14 during various stages of forming. FIG. 3 generally illustrates the first cylinder head 14 in a first (or initial) state. As seen in FIG. 3, a portion of an initial casting of the first cylinder head 14 is shown, including first and second walls 60, 62 obstructing fluid flow between the first and second portions 46, 48 of the coolant cavity 28. The first and second walls 60, 62 may be located generally opposite one another along the outer circumference of the wall 51 of the exhaust gas outlet 42 and may be formed at an interface where first and second casting cores (not shown) abut one another during casting of the first cylinder head 14. During casting, molten material, such as aluminum, used to form the first cylinder head 14 may extend into the region where the casting cores abut one another, forming the first and second walls.

In order to eliminate the first and second walls 60, 62, machining operations may be performed. By way of non-limiting example, the first and second walls 60, 62 may be drilled, as seen in FIGS. 4 and 5. With reference to FIG. 4, a first machining tool 64 may form the first passage 50 in the first cylinder head 14. The first machining tool 64 may engage an upper surface of the integrated exhaust manifold 26 generally adjacent to the exhaust gas outlet 42. By way of non-limiting example, the first machining tool 64 may include a drill bit. The first machining tool 64 may extend a distance into the first portion 46 of the coolant cavity 28 sufficient to engage the first wall 60. The first machining tool 64 may generally remove the first wall 60, providing fluid communication between the first and second portions 46, 48 of the coolant cavity 28.

With reference to FIG. 5, a second machining tool 66 may be located within the second passage 52 in the first cylinder head 14. By way of non-limiting example, the second machining tool 66 may include a drill bit. The second passage 52 may be formed during casting of the first cylinder head 14. The second machining tool 66 may be oriented at an angle relative to the lower surface 58 of the first cylinder head 14 and may extend into the second portion 48 of the coolant cavity 28. The second machining tool 66 may extend into the second portion 48 a distance sufficient to engage the second wall 62. The second machining tool 66 may generally remove the second wall 62, providing fluid communication between the first and second portions 46, 48 of the coolant cavity 28. After the machining of the first and second walls 60, 62 by the first and second machining tools 64, 66, a generally continuous flow path may exist between the first and second portions 46, 48 of the coolant cavity 28 around the entire circumference of the exhaust gas outlet 42.

What is claimed is:

1. A cast cylinder head comprising:

an exhaust port;

an exhaust manifold in fluid communication with the exhaust port, the exhaust manifold defining an exhaust gas outlet passage and an intermediate exhaust gas passage defining an exhaust gas flow path, the intermediate exhaust gas passage providing fluid communication between the exhaust port and the exhaust gas outlet passage; and a coolant cavity including first and second portions defined in the cylinder head at a location along the exhaust gas flow path aligned with the exhaust outlet passage and extending around an outer circumference of the exhaust outlet passage, the first and second portions being in fluid communication with one another through a first machined passage at the location along the exhaust gas flow path aligned with the exhaust outlet passage.

2. The cylinder head of claim 1, wherein the coolant cavity extends around the entire outer circumference of the exhaust outlet passage at the location along the exhaust gas flow path aligned with the exhaust outlet passage.

3. The cylinder head of claim 2, wherein the coolant cavity is concentric with the exhaust gas outlet passage.

4. The cylinder head of claim 1, further comprising an exhaust manifold outlet flange, the first and second portions of the coolant cavity located adjacent the outlet flange.

5. The cylinder head of claim 4, wherein the coolant cavity is defined in the cylinder head at allocation along the exhaust gas flow path between the intermediate exhaust gas passage and the exhaust manifold outlet flange.

6. The cylinder head of claim 1, wherein the coolant cavity includes a second machined passage providing fluid communication between the first and second portions of the coolant cavity.

7. The cylinder head of claim 6, wherein the second machined passage is located generally opposite the first machined passage along the outer circumference of the exhaust outlet passage.

8. The cylinder head of claim 1, wherein the coolant cavity is defined in a wall of the cylinder head that forms the exhaust gas outlet passage.

9. A cast cylinder head comprising:

an exhaust port;

an exhaust manifold in fluid communication with the exhaust port, the exhaust manifold defining an exhaust gas outlet passage and an intermediate exhaust gas passage providing fluid communication between the exhaust port and the exhaust gas outlet passage; and a coolant cavity defined in a wall of the cylinder head that forms the exhaust gas outlet passage and extending around an entire outer circumference of the exhaust outlet passage.

10. The cylinder head of claim 9, wherein the coolant cavity includes first and second cast-in portions, the first and second cast-in portions extending around the outer circumference of the exhaust outlet passage and being in fluid communication with one another through a first machined passage.

11. The cylinder head of claim 10, wherein the coolant cavity includes a second machined passage providing fluid communication between the first and second cast-in portions of the coolant cavity.

12. The cylinder head of claim 11, wherein the second machined passage is located generally opposite the first machined passage along the outer circumference of the exhaust outlet passage.

13. The cylinder head of claim 9, wherein the coolant cavity is concentric with the exhaust gas outlet passage.

* * * * *